US006068456A

United States Patent [19]

Tuckey et al.

[11] Patent Number: 6,068,456

[45] Date of Patent: May 30, 2000

[54] TAPERED CHANNEL TURBINE FUEL PUMP

[75] Inventors: Charles H Tuckey, Sand Point; Joseph M Ross, Millington; Kirk D Fournier, Essexville, all of Mich.

[73] Assignee: Walbro Corporation, Cass City, Mich.

[21] Appl. No.: 09/024,168

[22] Filed: Feb. 17, 1998

[51] Int. Cl.[7] ..... F04B 17/00

[52] U.S. Cl. ..... 417/423.3

[58] Field of Search ..... 415/55.2, 55.6, 415/55.7, 55.4, 55.1, 55.3, 55.5, 200; 417/423.14, 423.3

[56] References Cited

U.S. PATENT DOCUMENTS

| | | | |
|---|---|---|---|
| 4,591,311 | 5/1986 | Matsuda et al. | 415/53 |
| 4,715,777 | 12/1987 | Tuckey | 415/53 |
| 5,257,916 | 11/1993 | Tuckey | 417/423.3 |
| 5,310,308 | 5/1994 | Yu et al. | 415/55.6 |
| 5,401,147 | 3/1995 | Yu | 417/423.14 |
| 5,486,087 | 1/1996 | Treiber et al. | 415/55.1 |
| 5,702,229 | 12/1997 | Moss et al. | 415/55.4 |

*Primary Examiner*—Teresa Walberg
*Assistant Examiner*—Leonid Fastovsky
*Attorney, Agent, or Firm*—Reising, Ethington, Barnes, Kisselle, Learman & McCulloch, P.C.

[57] ABSTRACT

An electric motor regenerative or turbine type fuel pump has a fuel pumping channel with a cross sectional area which decreases from adjacent its inlet to at least midway through the pumping channel to improve the efficiency and vapor handling capability of the fuel pump. Preferably, the pumping channel generally continuously decreases in cross-sectional area from its inlet to its outlet. In one form, the pumping channel is defined between a pair of plates or caps and a split ring received between the caps and surrounding an impeller having a plurality of vanes formed about its periphery and disposed within the pumping channel. Each of the caps preferably has a groove therein forming a portion of the pumping channel with each of the grooves having a greater cross sectional area adjacent the inlet of the pumping channel compared to the outlet of the pumping channel. In another form, a so-called side channel turbine pump, has a pumping channel defined by a groove in a flat face of a stator and a rotor driven to rotate by the motor has a circumferential array of vanes formed in a flat face and in communication with the pumping channel to develop increasing pressure from the inlet to the outlet of the pumping channel. This pumping channel has a greater depth and hence a greater cross sectional area adjacent its inlet as compared to its outlet.

11 Claims, 4 Drawing Sheets

TAPERED CHANNEL TURBINE FUEL PUMP

FIELD OF THE INVENTION

This invention relates generally to fuel pumps and more particularly to a turbine type fuel pump.

BACKGROUND OF THE INVENTION

Electric motor turbine type fuel pumps have been used in automotive engine fuel delivery systems and the like. These pumps typically include a housing adapted to be immersed in a fuel supply tank with an inlet for drawing liquid fuel from the surrounding tank and an outlet for supplying fuel under pressure to the engine. The electric motor drives a pump impeller with an array of circumferentially spaced vanes about the periphery of the impeller. An arcuate pumping channel, with an inlet port and an outlet port at opposed ends surrounds the impeller periphery for developing fuel pressure through a vortex-like action on liquid fuel in pockets formed by the impeller vanes and the surrounding channel. One example of a fuel pump of this type is illustrated in U.S. Pat. No. 5,257,916.

A second example of a fuel pump of this type is disclosed in U.S. Pat. No. 4,591,311, assigned to Nippondenso Co., Ltd. This fuel pump has a discrete, enlarged cross sectional area, low pressure section of its pumping channel which leads to a discrete, high pressure section which has a smaller cross sectional area than the low pressure section. The low pressure section extends less than 180° from the suction port of the pumping channel, and as specifically disclosed, preferably extends through only the first quarter of the pumping channel. Both the high and low pressure sections have constant cross sectional areas throughout their respective arcuate extents. A vapor discharge port communicates with the enlarged low pressure section at its downstream end.

A second type of turbine fuel pump is generally referred to as a side or lateral channel fuel pump. This fuel pump has a rotor with a circumferential array of vanes formed in one face of the rotor and an arcuate pumping channel formed by a groove in a flat face of a stator communicating with the vanes to develop increasing fuel pressure from the inlet port to the outlet port of the pumping channel as the rotor is rotated by an electric motor. One example of a fuel pump of this type is illustrated in U.S. Pat. No. 4,715,777.

Despite significant improvements in the design and construction of turbine type fuel pumps, they are generally very inefficient with an efficiency of generally between about 20% to 45%, and when combined with a typical electric motor having an efficiency of about 45% to 50%, the fuel pumps have an overall efficiency of between about 10% to 15%. Further, it is desirable to reduce the ingestion of vapor into the fuel pump and the amount of vapor discharged from the fuel pump and thus, there is a continuing need to increase the efficiency and vapor handling capabilities of turbine type fuel pumps.

SUMMARY OF THE INVENTION

An electric motor regenerative or turbine type fuel pump with a fuel pumping channel which has a cross sectional area which progressively decreases from adjacent its inlet to at least about midway through the pumping channel to improve the efficiency and vapor handling capability of the fuel pump. Preferably, the pumping channel is generally continuously tapered from its inlet to its outlet. In one form, the pumping channel is defined between a pair of plates or caps, and a split ring received between the caps and surrounding an impeller having a plurality of vanes formed about its periphery and disposed within the pumping channel. Each of the caps preferably has a shallow groove therein forming a portion of the pumping channel with each of the grooves having a cross sectional area which is larger adjacent the inlet of the pumping channel compared to the outlet of the pumping channel. In a so-called side channel turbine pump, the arcuate pumping channel groove, in a flat face of a stator and communicating with the rotor vanes, has a larger cross sectional area adjacent its inlet as compared to its outlet.

Objects, features and advantages of this invention include providing an electric motor turbine type fuel pump which has significantly increased efficiency of the fuel pump, improved vapor handling capability, is of relatively simple design and economical manufacture and assembly, and has a long useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
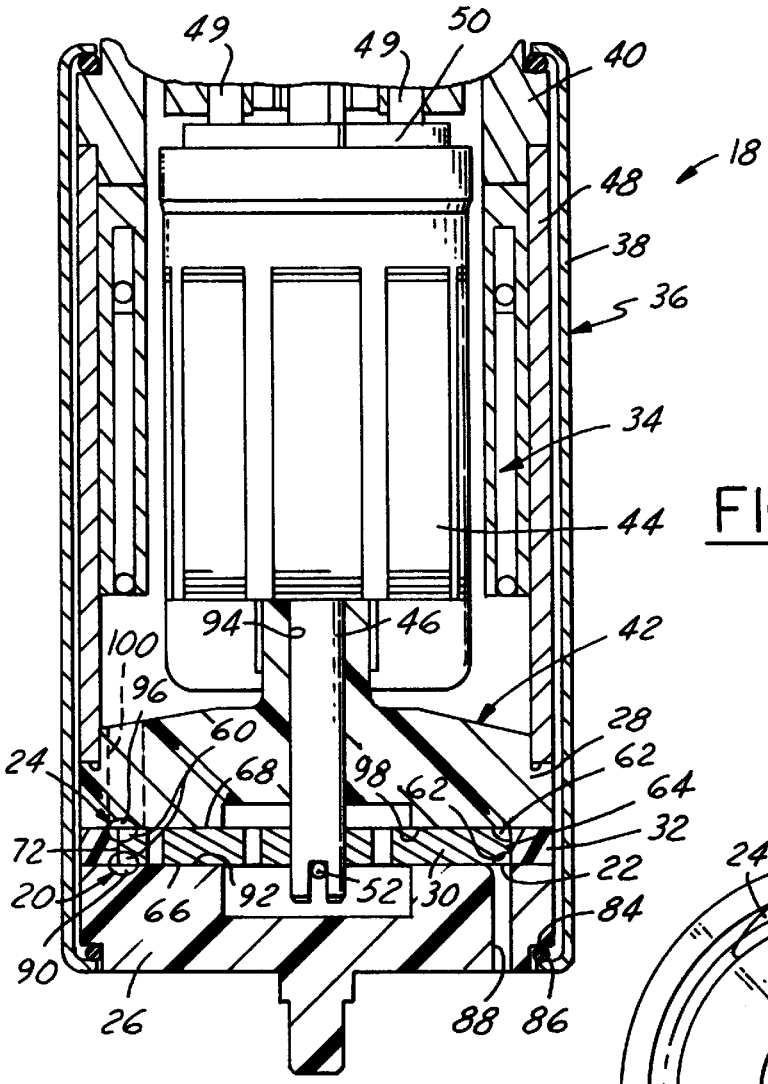
FIG. 1 is a partial sectional view of an electric motor turbine type fuel pump having a tapered fuel pumping channel according to the present invention.

Referring in more detail to the drawings, FIG. 1 illustrates an electric motor turbine type fuel pump 18 embodying the invention with a fuel pumping channel 20 having an inlet 22 adjacent one end and an outlet 24 adjacent its other end. The cross sectional area of the pumping channel 20 decreases from adjacent the inlet 22 to at least about midway of the arcuate extent of the pumping channel 20 and preferably, decreases generally uniformly from its inlet 22 all the way to its outlet 24. The pumping channel 20 is defined between an inlet end cap 26, an upper cap 28, an impeller 30 received between them and a split ring 32 surrounding the periphery of the impeller 30. The impeller 30 is driven to rotate by the electric motor 34 to draw fuel into the inlet port 22 of the pumping channel 20, increase the pressure of the fuel within the pumping channel 20, and discharge the fuel from the outlet port 24 of the pumping channel 20 under pressure.

The fuel pump 18 has a housing 36 formed by a cylindrical shell 38 that joins together the axially spaced inlet cap 26 and an outlet end cap 40 with the electric motor 34 and fuel pumping assembly 42 disposed between the inlet and outlet end caps 26, 40. The electric motor 34 comprises a rotor 44 journalled by a shaft 46 for rotation within the housing 36 and surrounded by a permanent magnet stator 48. Brushes 49 are urged into electrical sliding contact with a commutator plate 50 carried by the rotor 44 and the shaft 46. The rotor 44 is coupled to the impeller 30 by a wire clip 52 for corotation of the impeller 30 with the shaft 46 to generate pressure within the pumping channel 20.

The impeller 30 has an array of circumferential spaced and radially and axially extending vanes 60 defining pockets 62 therebetween and an axially centered and radially extending circumferentially continuous rib 64. The rib 64 is centered between the opposed axial side faces 66, 68 of the impeller 30 and cooperates with the vanes 60 to form an array of equally circumferential spaced and axially and radially opening identical pockets 62 on both of the opposed axial side faces 66, 68 of the impeller 30. In the preferred construction, the impeller vanes 60 comprise so-called closed vanes in which the pockets 62 on one face 66 of the impeller 30 do not communicate with the pockets 62 on the other side 68 of the impeller 30. However, so-called open vane constructions of the type disclosed in U.S. Pat. No. 5,257,916, which is incorporated herein by reference, may also be employed usually with some loss of pumping efficiency. Although the pockets 62 on the opposed axial faces of the impeller 30 are preferably aligned with each other, staggered pockets may also be employed.

The split ring 32 has an external alignment notch (not shown) to facilitate locating the ring 32 with respect to the end cap 26 within the housing 36 and has an axially centrally disposed and radially inwardly extending rib 72 spanning the majority of the interior surface of the ring 32. In assembly, the rib 72 is axially aligned with and radially opposed to the rib 64 of the impeller 30 to divide the pumping channel 20 into separate upper and lower pumping channels along the length of the rib 72.

A vapor vent port 80 (FIG. 2) preferably extends through the inlet end cap 26 and may be disposed substantially anywhere along the pumping channel 20 or even in the cross-over or "stripping area" 82 defined between the inlet and outlet ports 22, 24. The vapor vent port 80 is preferably positioned to sequentially register with the radially innermost portion of the pockets 62 defined between adjacent vanes 60 to vent air and fuel vapor which collects in the pockets 62 when they are separated from the higher density liquid fuel due to the centrifugal forces generated by the rotating impeller 30.

Figure 2:
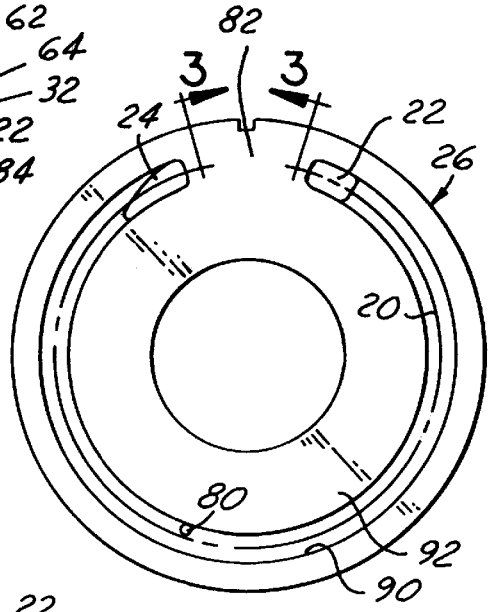
FIG. 2 is a top view of an inlet end cap of the fuel pump of FIG. 1.
Figure 3:
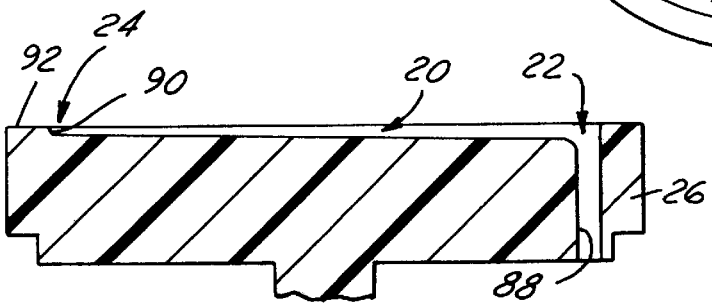
FIG. 3 is a sectional view of the inlet end cap taken along line 3—3 of FIG. 2.
Figure 10:
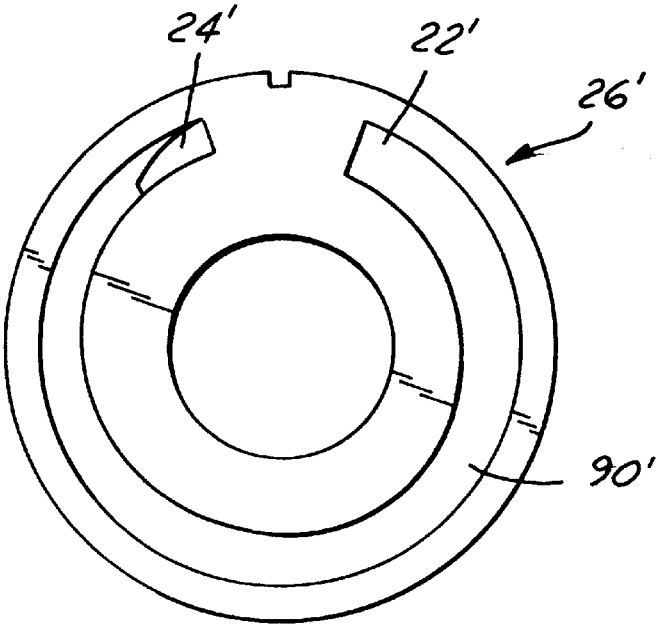
FIG. 10 is a top view of an inlet end cap of an alternate embodiment of the invention.

The inlet end cap 26 is mounted against rotation within the housing 36 and has an annular shoulder 84 into which an open end of the shell 38 is rolled preferably with a sealing member such as an O-ring 86 received between them. A fuel inlet passage 88 in the inlet end cap 26 opens into the inlet port 22 of the pumping channel 20. As shown in FIG. 2, an arcuate groove 90 formed in the upper flat face 92 of the inlet end cap 26 defines in part the lower portion of the pumping channel 20. As shown in FIG. 3, wherein the arcuate pumping channel 20 is shown straight, the groove 90 in the inlet end cap 26 becomes shallower towards the outlet port 24 of the pumping channel 20 and has its deepest portion adjacent to the inlet port 22. Although shown having a generally constant or uniform taper from the inlet port 22 to the outlet port 24, the groove 90 may be tapered starting from the inlet port 22 and ending anywhere downstream of a point generally half way around the arcuate extent of the groove 90 or, in other words, any point between the midway point of the pumping channel 20 and the outlet port 24. Downstream of this point the pumping channel may have a uniform depth and a uniform cross sectional area. Also, while the groove 90 is preferably formed with a generally constant taper, the reduction in cross sectional area of the groove 90 from the inlet 22 towards the outlet 24 may also be achieved with a varied taper wherein various portions may have a more or less gradual taper. In another embodiment end cap 26', as shown in FIG. 10, the groove 90' has a generally uniform, constant depth but has a decreasing radial width from its inlet 22' to at least generally half way around its arcuate extent and preferably substantially all the way to its outlet port 24'.

Figure 4:
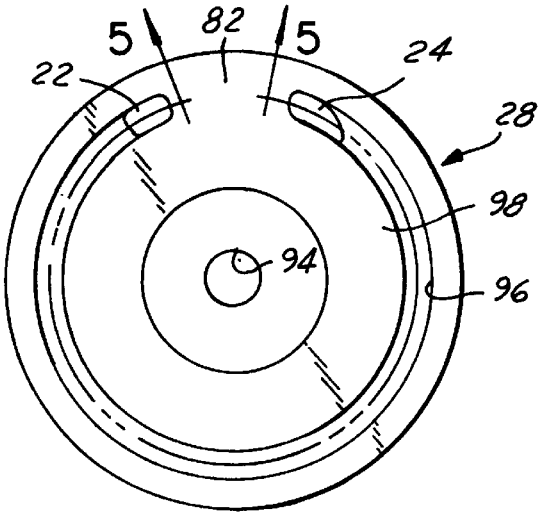
FIG. 4 is a bottom view of an upper cap of the fuel pump of FIG. 1.
Figure 5:
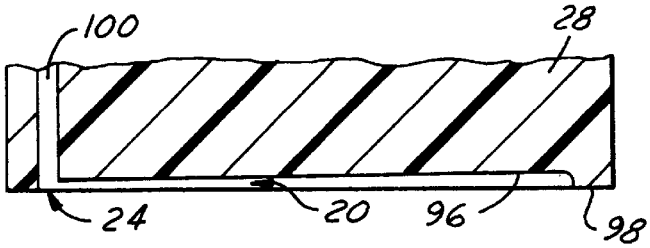
FIG. 5 is a partial sectional view of the upper cap taken along line 5—5 of FIG. 4.

The upper cap 28 is also mounted against rotation within the housing 36 between the stator 48 and the ring 32 and has a central through bore 94 which receives the shaft 46. As shown in FIGS. 4 and 5, an arcuate groove 96 formed in a lower flat face 98 of the upper cap 28 defines the upper extent of the pumping channel 20 and is preferably complementary shaped to the groove 90 in the inlet end cap 26. An outlet passage 100 through the upper cap 28 communicates the outlet port 24 with the interior of the pump housing 36. The groove 96 in the upper cap 28 is also preferably uniformly tapered or otherwise constructed similarly to the inlet end cap groove 90 to provide a greater cross sectional area of the groove adjacent the inlet port 22 of the pumping channel 20 than adjacent the outlet port 24 of the pumping channel 20. Regardless of the construction of the grooves 90, 96, the cross sectional area adjacent the pumping channel inlet 22 is desirably 10% to 60%, and preferably 20% to 40%, greater than the cross sectional area adjacent the pumping channel outlet 24.

Figure 7:
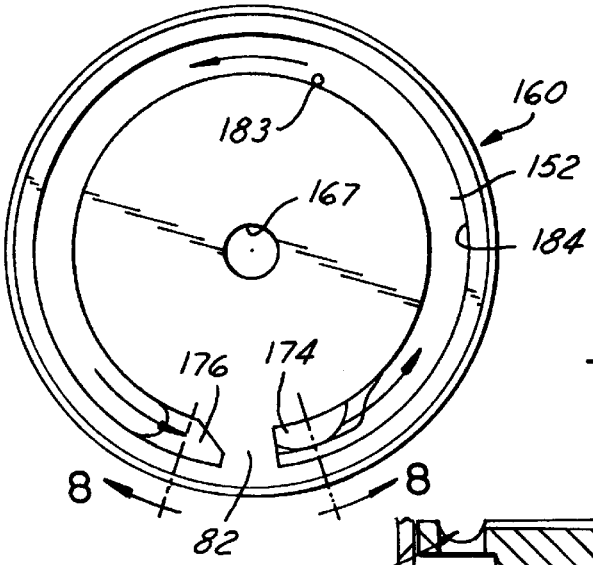
FIG. 7 is an end view of a stator of the fuel pump of FIG. 6.
Figure 8:
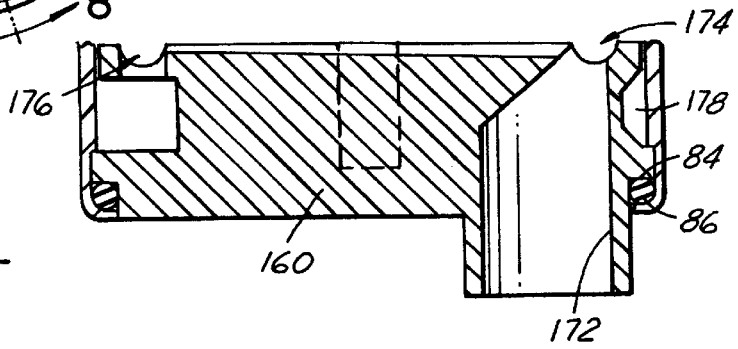
FIG. 8 is a sectional view of the stator taken along line 8—8 of FIG. 7.
Figure 6:
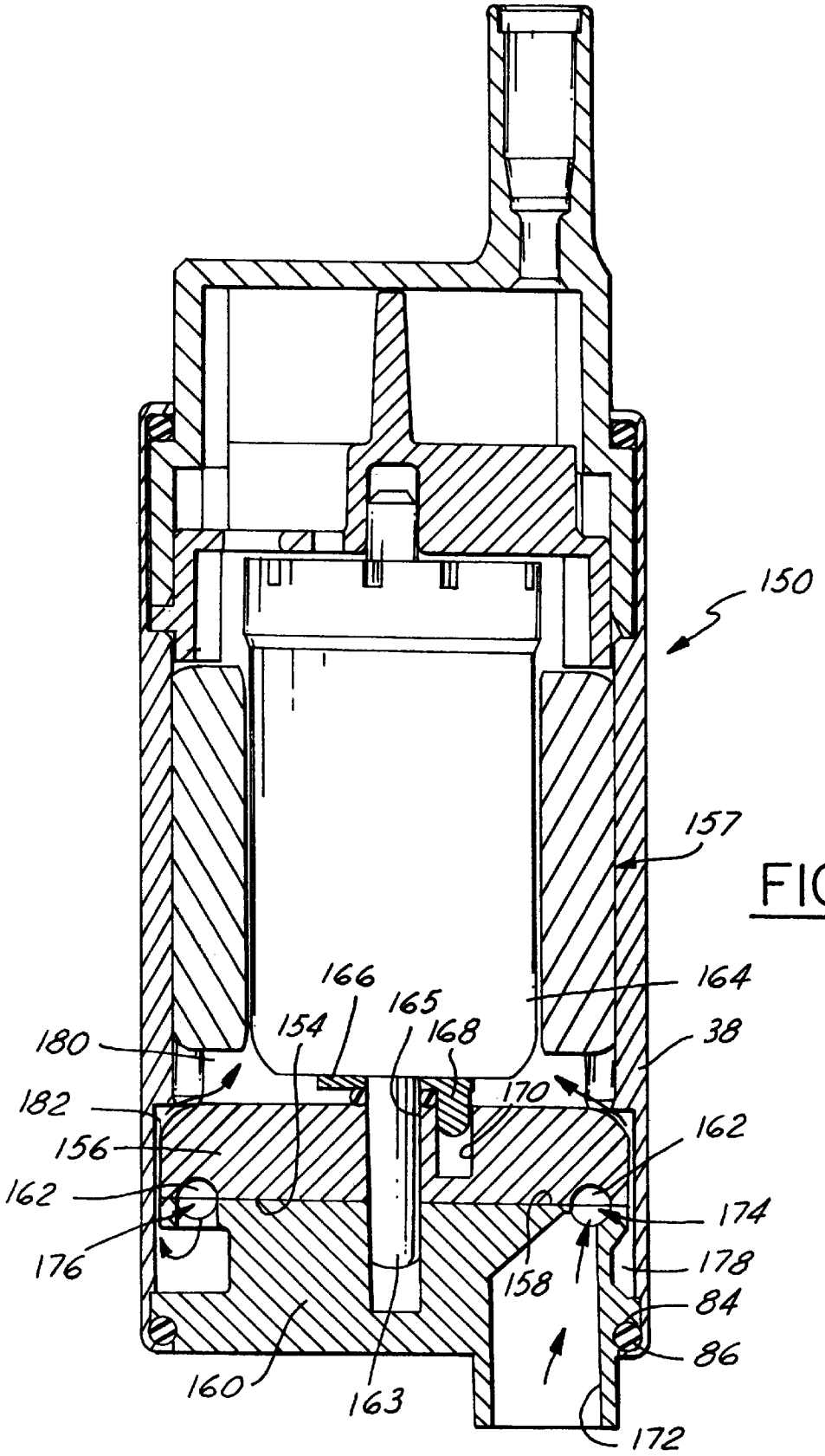
FIG. 6 is a partial sectional view of a side channel turbine type fuel pump.
Figure 9:
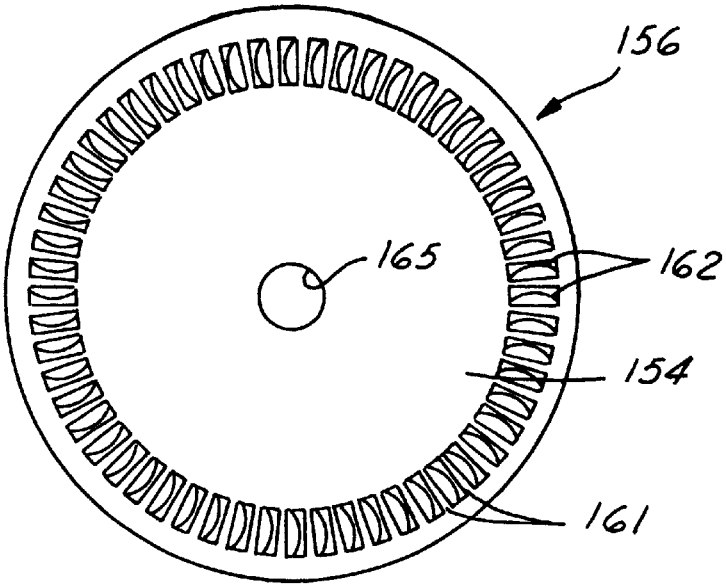
FIG. 9 is an end view of a rotor of the fuel pump of FIG. 6.

In another form, as shown in FIGS. 6–9, a lateral or side channel turbine type fuel pump 150 has a fuel pumping channel 152 defined between a flat lower face 154 of a rotor 156 driven to rotate by an electric motor 157 and a flat upper face 158 of an inlet end cap 160 in which the pumping channel 152 is formed. As shown in FIGS. 6 and 9, the rotor has a circular path of a plurality of individual vanes 162 formed in its lower face 154 and communicating with the pumping channel 152 so that when the rotor 156 is rotated, pressure is generated within the pumping channel 152. The vanes 162 are circumferentially spaced apart and extend generally radially and axially to define a plurality of circumferentially spaced apart individual pockets 161 having a generally semi-cylindrical configuration. The rotor 156 is coupled to an armature 164 of the motor 157 by a clip 166 having depending fingers 168 received in holes 170 in the rotor 156. The armature 164 is journalled for rotation by a shaft 163 received through a bore 165 in the rotor 156 and extending into a blind bore 167 of the inlet end cap 160.

The inlet end cap 160 is mounted against rotation within the shell 38 of the housing 36 and has an inlet passage 172 through which fuel is drawn into the inlet port 174 of the pumping channel 152. An outlet port 176 of the pumping channel 152 empties into a circumferentially extending groove 178 formed in the peripheral edge of the inlet end cap 160 which communicates with a chamber 180 defined in the housing 36 downstream of the rotor 156 through a clearance gap 182 between the shell 38 and both the upper portion of the edge of the inlet end cap 160 and the rotor 156. A vapor vent port 183 preferably extends through the inlet end cap 160 and may be disposed anywhere along the pumping channel 152 or even in the stripping area 82. As shown in FIG. 7, the pumping channel 152 is defined by a groove 184 which opens into the upper face 158 of the inlet end cap 160, is generally circular preferably spanning about 330° to 350° and is spaced radially inwardly of the outer edge of the inlet end cap 160. As shown in FIG. 8, the groove 184 becomes increasingly shallow and thus has a decreasing cross sectional area from the inlet port 174 of the pumping channel 152 to the outlet port 176 of the pumping channel 152. As in the first embodiment, the largest cross-sectional area portion of the pumping channel 152 is disposed adjacent the inlet port 174 of the pumping channel 152 and the taper reducing the cross-sectional area of a given increment of the pumping channel 152 may terminate at about the mid point of the arcuate extent of the pumping channel 152 or thereafter with the remaining portion of the pumping channel 152 having a generally constant shape and cross-sectional area. Preferably, as in the first embodiment, the pumping channel 152 has a cross sectional area which generally uniformly decreases by decreasing its depth from the inlet 174 to the outlet 176. Alternatively, the pumping channel 152 may be formed with a decreasing width from the inlet 174 to the outlet 176. Regardless of the construction and shape of the pumping channel 152, the cross sectional area of the pumping channel 152 adjacent its inlet 174 is desirably 10% to 60%, and preferably 20% to 40% larger than the cross sectional area of the pumping channel 152 adjacent its outlet 176.

Empirical data has shown that in each embodiment, the tapered fuel pumping channel 20, 152 improves both the efficiency and the vapor handling capability of the turbine type fuel pumps 18, 150 in use. A more efficient fuel pump 18, 150 with better vapor handling capabilities will in turn provide a smoother operating fuel system and engine.

What is claimed is:

1. An electric motor turbine-type fuel pump comprising:

a housing;

a pump body in the housing and having an arcuate pumping channel, a fuel inlet adjacent one end of the channel and a fuel outlet adjacent the other end of the channel;

a rotor having a plurality of circumferentially spaced vanes defining a plurality of circumferentially spaced pockets communicating with the pumping channel;

an electric motor connected with the rotor to rotate the rotor to draw fuel through the fuel inlet into the pumping channel and to discharge fuel from the fuel outlet under pressure; and the pumping channel is generally uniformly tapered and decreases in cross-sectional area from closely adjacent the fuel inlet of the pumping channel to at least midway of the arcuate extent between the inlet and the outlet of the pumping channel, and the pumping channel has a cross sectional area closely adjacent its fuel inlet which is between about 10% to 60% greater than the cross sectional area adjacent the fuel outlet of the pumping channel.

2. The fuel pump of claim 1 wherein the pumping channel has a greater depth adjacent the fuel inlet than adjacent the fuel outlet.

3. The fuel pump of claim 1 wherein the pumping channel is wider adjacent the fuel inlet than adjacent the fuel outlet.

4. The fuel pump of claim 1 wherein the rotor has a plurality of vanes formed within a flat face of the rotor and in communication with the pumping channel.

5. The fuel pump of claim 1 which also comprises a vent port formed in the body in communication with the pumping channel through which at least some of the air and fuel vapor in the pumping channel may escape.

6. The fuel pump of claim 1 wherein the pumping channel has a cross sectional area adjacent its fuel inlet which is between about 20% to 60% greater than the cross sectional area adjacent the fuel outlet of the pumping channel.

7. The fuel pump of claim 1 wherein the pumping channel has a cross sectional area closely adjacent its fuel inlet which is between about 20% to 40% greater than the cross sectional area adjacent the fuel outlet of the pumping channel.

8. The fuel pump of claim 1 which also comprises a second body disposed adjacent the rotor and having an arcuate groove formed therein and defining in part the pumping channel.

9. The fuel pump of claim 8 wherein the rotor is received between the pump body and the second body and defines in part the pumping channel about the periphery of the rotor.

10. The fuel pump of claim 8 wherein the groove of the second body has a greater cross sectional area adjacent the fuel inlet of the pumping channel than adjacent the fuel outlet of the pumping channel.

11. The fuel pump of claim 1 wherein the pumping channel is generally uniformly tapered from its fuel inlet to its fuel outlet.

* * * * *